US006287050B1

(12) United States Patent
Montgomery et al.

(10) Patent No.: US 6,287,050 B1
(45) Date of Patent: Sep. 11, 2001

(54) FOUNDATION FLOOD GATE WITH VENTILATION

(75) Inventors: Martin J. Montgomery, Avalon; E. Carl Sprengle, Glassboro, both of NJ (US)

(73) Assignee: Smart Vent, Inc., Avalon, NJ (US)

( * ) Notice: Subject to any disclaimer, the term of this patent is extended or adjusted under 35 U.S.C. 154(b) by 0 days.

(21) Appl. No.: 09/386,791

(22) Filed: Aug. 31, 1999

Related U.S. Application Data

(63) Continuation-in-part of application No. 09/079,611, filed on May 15, 1998, now Pat. No. 5,944,445.

(60) Provisional application No. 60/052,819, filed on Jul. 10, 1997.

(51) Int. Cl.[7] ..... E02B 7/20; E02B 7/40

(52) U.S. Cl. ..... 405/92; 405/87; 405/94; 52/573.1

(58) Field of Search ..... 405/87, 92, 94, 405/95, 96, 99, 100, 101, 102; 454/237, 238, 273, 271; 52/573.1, 1, 19, 169.5, 302.1, 473

(56) References Cited

U.S. PATENT DOCUMENTS

| | | | | |
|---|---|---|---|---|
| 73,159 | * | 1/1868 | Besse | 405/96 |
| 100,623 | | 3/1870 | Hays . | |
| 911,290 | | 2/1909 | Burkett . | |
| 1,089,232 | * | 3/1914 | Larson | 405/94 |
| 2,105,735 | | 1/1938 | Hodge | 189/71 |
| 2,118,535 | | 5/1938 | Betts | 405/94 |
| 2,565,122 | | 8/1951 | Cowan | 98/118 |
| 2,611,310 | | 9/1952 | Cowan | 98/118 |
| 2,754,747 | | 7/1956 | Bertling | 98/106 |
| 2,774,116 | | 12/1956 | Wolverton | 20/16 |
| 2,798,422 | | 7/1957 | Bourque | 98/87 |
| 3,123,867 | | 3/1964 | Combs | 20/16 |
| 3,425,175 | | 2/1969 | Gerde | 52/169 |
| 3,680,329 | | 8/1972 | Burtis | 62/275 |
| 3,683,630 | * | 8/1972 | Alexandre | 405/97 |
| 3,939,863 | | 2/1976 | Robison | 137/357 |
| 3,974,654 | * | 8/1976 | Mirto et al. | 405/127 |
| 4,048,771 | * | 9/1977 | Thistlethwaite | 52/127.2 |
| 4,116,213 | | 9/1978 | Kamezaki | 137/360 |
| 4,174,913 | | 11/1979 | Schliesser | 405/94 |
| 4,227,266 | | 10/1980 | Russell | 4/496 |
| 4,290,635 | * | 9/1981 | McKenzie | 292/290 |
| 4,349,296 | | 9/1982 | Langeman | 405/99 |
| 4,576,512 | * | 3/1986 | Combes et al. | 405/100 |
| 4,606,672 | * | 8/1986 | LeSire | 405/87 |
| 4,669,371 | | 6/1987 | Sarazen, Jr., et al. | 98/29 |
| 4,699,045 | * | 10/1987 | Hensley | 98/37 |
| 4,754,696 | * | 7/1988 | Sarazen et al. | 52/573.1 X |

(List continued on next page.)

FOREIGN PATENT DOCUMENTS

| | | | | |
|---|---|---|---|---|
| 2147933 | * | 5/1985 | (GB) | 405/97 |
| 04203112 | * | 7/1992 | (JP) | 405/96 |

*Primary Examiner*—David Bagnell
*Assistant Examiner*—Jong-Suk Lee
(74) *Attorney, Agent, or Firm*—Akerman Senterfitt

(57) ABSTRACT

A flood gate for use in a foundation crawl space and the like comprises a frame having side walls defining a fluid passageway therethrough, a door pivotally mounted in the frame for bidirectional rotation between two open positions and a closed position therebetween to permit tidal water flow therethrough, and at least one catching assembly for holding the door in the closed position against a minimum level of pressure of the tidal water flow. Tidal flood waters exceeding the minimum pressure level are automatically vented through the crawl space and the like reducing a risk of structural damage from the tidal flood waters. The flood gate can further comprise a door having a ventilation opening, an automatic louver assembly for controlling air flow through the opening, and a screen covering the opening. The automatic louver assembly opens and closes responsive to ambient temperature.

24 Claims, 6 Drawing Sheets

U.S. PATENT DOCUMENTS 5,253,804 * 10/1993 Sarazen, Jr. et al. ..... 454/256 X
5,293,920 3/1994 Vagedes ..... 160/89
5,460,572 10/1995 Waltz et al. ..... 454/273
5,487,701 1/1996 Schedegger et al. ..... 454/271
5,577,863 * 11/1996 Nottle ..... 405/87
5,944,445 * 8/1999 Montgomery ..... 405/92

* cited by examiner

FOUNDATION FLOOD GATE WITH VENTILATION

CROSS REFERENCE TO RELATED APPLICATION

This is a Continuation-In-Part of application Ser. No. 09/079,611 filed May 15, 1998, U.S. Pat. No. 5,944,445. Application Ser. No. 09/079,611 claims the benefit of provisional application No. 60/052,819 filed July 10, 1997.

BACKGROUND OF THE INVENTION

1. Field of the Invention

This invention relates generally to crawl space and basement venting, and in particular, to the flood venting of enclosed spaces within a foundation.

2. Description of Related Art

Building Officials and Code Administrators (BOCA) regulations mandate that buildings with subgrade level, enclosed spaces, such as crawl spaces, located in low-lying coastal flood areas, provide for adequate relief from tidal flood waters stemming from oncoming tides and receding waters. As a solution to the problem of tidal flood waters, local regulations and good construction practice employ the use of venting. However, while venting allows for tidal waters to ebb and flow through the enclosed space, the venting should not allow access by small animals, insects, and other pests through the openings in the enclosed space. In particular, BOCA regulations require flood venting for all new construction in low lying coastal flood areas. Furthermore, NOCA regulations require the use of flood venting where renovations to an existing structure exceed fifty percent of the value of the property.

Notwithstanding, good construction practice also embraces the use of vents which can be opened during warmer months to allow for air ventilation to permit moisture to escape from crawl spaces, while retaining the ability to close during colder months to prevent the circulation of cold air around exposed plumbing in crawl spaces. Thus, because the use of screening and louvers is necessary to achieve both the warm weather and cold weather requirements of proper venting, a flood vent must be able to automatically remove the louver and screen barrier when confronted with free flowing tidal flood water.

Generally, a wide variety of devices have been developed which may be utilized to provide pressure relief from both liquid and gaseous forces. With respect to gas pressure relief devices, U.S. Pat. No. 3,680,239, issued Aug. 1, 1972 to Burtis for PRESSURE EQUALIZING VALVE, discloses a device to relieve overpressure and underpressure in the opening and closing of a door of a refrigerated space. U.S. Pat. No. 2,774,116, issued Dec. 18, 1956 to Wolverton for DOUBLE ACTING RELIEF VALVE, U.S. Pat. No. 2,798,422, issued Jul. 9, 1957 to Bourque for AIR RELIEF MEANS FOR DOORS, and U.S. Pat. No. 3,123,867, issued Mar. 10, 1964 to Combs for VESTIBULE PRESSURE EQUALIZER relate to the equalization of differential air pressure experienced in the swinging of one door relative to another door. Additionally, U.S. Pat. No. 2,105,735, issued Jan. 18, 1938 to Hodge for PRESSURE RELEASING APPARATUS, and U.S. Pat. No. 4,116,211, issued Sept. 26, 1978 to Kamezaki for AIR PRESSURE CONTROL APPARATUS FOR A HOT OR COLD STORAGE CHAMBER, teach methods to release pressure in closed chambers resulting from changing temperatures within the chamber. In particular, the Kamezaki apparatus utilizes a swinging damper hinged at the top of an enclosing frame. Nevertheless, neither the Kamezaki apparatus nor other inventions contemplate the use of a vented damper able to relieve pressure resulting from fluid flow.

Correspondingly, several devices have been developed which provide relief from overpressure resulting from the flow of water and other liquids. U.S. Pat. No. 4,349,296, issued Sept. 14, 1982 to Langeman for IRRIGATION DITCH GATE describes a gate for an irrigation ditch, which during normal conditions through the use of tensioned springs, maintains flood gates in a closed position, but upon flood conditions, allows for the gates to open. U.S. Pat. No. 3,939,863, issued Feb. 24, 1976 to Robison for BASEMENT SUMP CONSTRUCTION discloses a basement drain containing a trap for the prevention of back flow of flood water. U.S. Pat. No. 4,174,913, issued Nov. 20, 1979 to Schliesser for ANIMAL GUARD FOR FIELD PIPE relates to an invention which, while allowing for the free-flow exit of debris carrying effluents from an open pipe end, prevents animal entry into the pipe. Still, none of the aforementioned devices contemplate the integration of a liquid flow control device with a temperature controlled ventilation system.

Presently, several patents disclose methods for ventilating enclosed foundation spaces. U.S. Pat. No. 5,293,920, issued Mar. 15, 1994 to Vagedeg for LOUVERED BASEMENT VENT, and U.S. Pat. No. 5,487,701, issued Jan. 30, 1996 to Schedegger et al. for PLASTIC FOUNDATION VENT, embody louvered basement vents which can be manually adjusted to limit air flow in colder temperatures, and to maximize air flow in hotter conditions. U.S. Pat. No. 5,460,572, issued Oct. 24, 1995 to Waltz et al. for FOUNDATION ventilator discloses merely a one-piece molded plastic foundation ventilator without louvers. The Waltz invention, however, contemplates the manual use of hinged doors to regulate air flow through to the foundation. U.S. Pat. No. 2,754,747, issued Jul. 17, 1956 to Bertling for AIR REGISTER OR LOUVER, embodies a hinged, louvered door, designed to facilitate the maintenance of the screen behind the louvered door. Nonetheless, the louvers are designed to be operated manually by the user.

All of the aforementioned foundation ventilators contain screening to prevent small animals, insects and other pests from gaining access to the enclosed area. Significantly, none of the aforementioned foundation ventilators will act as a water pressure relief valve in response to the ebb and flow of tidal waters. Furthermore, none provide for the automatic adjustment of louvers in response to increasing or decreasing temperature so as to prevent either the rotting of the elements of the structure's foundation, or the freezing of pipes within the enclosed space. Accordingly, the prior art has not provided an integrated method to automatically ventilate an enclosed space of a foundation while allowing for the relief of liquid pressure on either side of the vent, and preventing small animals, insects and pests from entering the enclosed space.

SUMMARY OF THE INVENTION

The subject invention has advantages over all current air vents now used and provides a novel and nonobvious opening for the entry and exit of tidal flood waters. The maintenance free flood vent can be installed in new and existing crawl spaces and foundations and can remain in use year round. These vents have particular utility in areas designated by the Federal Emergency Management Agency (FEMA) as low lying, flood areas. When installed, the vent will allow for the free passage of air ventilation in warm temperatures and the temperature controlled louvers will close fully in colder temperatures.

Also, the louvered panel will be screened to prevent penetration by small animals, insects, and other pests and will operate like a pivotally connected gate. The panel can be secured in the closed position by a latching mechanism that senses the height of water surrounding the vent and releases the panel at a predetermined height.

A vent in accordance with an inventive arrangement can remain open for regular air ventilation in warm weather conditions, can close to block off air flow during cold weather conditions and can, at any time, open to enable the passage of flood water into and out of the crawl space.

A flood gate for use in a foundation crawl space and the like comprises a frame having side walls defining a fluid passageway therethrough, a door pivotally mounted in the frame for bidirectional rotation between two open positions and a closed position therebetween to permit tidal water flow therethrough, and at least one latching mechanism, for holding the door in the closed position against a minimum level of water, whereby waters exceeding the minimum water height are automatically vented through the crawl space and the like reducing a risk of structural damage from the tidal flood waters. A flood gate advantageously comprises a door having a ventilation opening, an automatic louver assembly for controlling air flow through the opening, and a screen covering the opening. An automatic louver assembly opens and closes responsive to ambient temperature.

A method for integrating ventilation of an enclosed space and relief from tidal flooding of an enclosed space comprises the steps of: maintaining a vent door in a closed position absent tidal flooding, automatically opening and closing vents in the vent door in response to changes in ambient temperature and opening the vent door in response to sufficient pressure exerted by flood waters during tidal flooding. The automatic adjusting vents comprises the steps of: automatically sensing ambient temperature, automatically opening the vents in response to warmer ambient temperatures, and automatically closing the vents in response to cooler ambient temperatures. The method can further comprise: automatically biasing the vent door to the closed position, releasably latching the vent door in the closed position, and allowing the vent door to swing open in the direction of the tidal flow.

BRIEF DESCRIPTION OF THE DRAWINGS

Presently preferred and alternative embodiments of the inventive arrangements are shown in the drawings, it being understood, however, the inventive arrangements are not limited to the precise arrangements and instrumentalities shown.

DESCRIPTION OF THE PREFERRED EMBODIMENTS

Figure 1A:
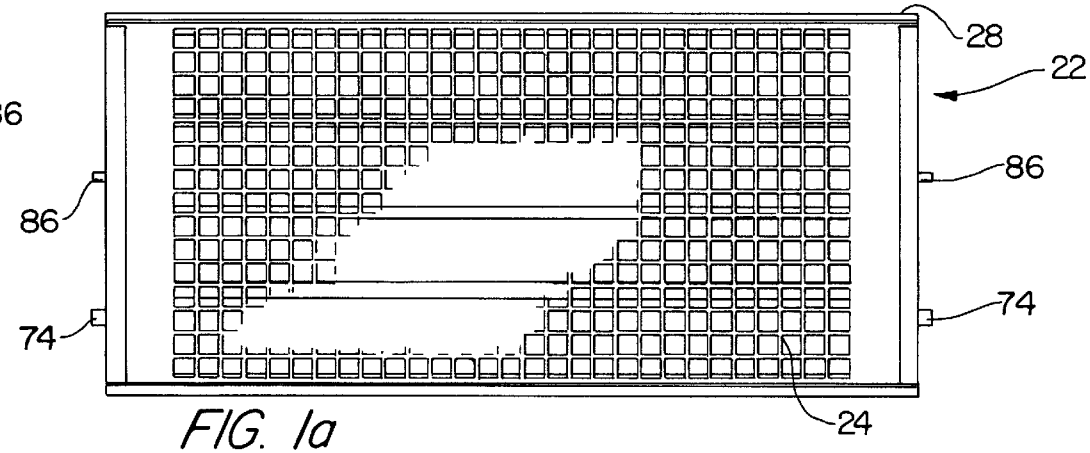
FIG. 1*a* is a front elevation of a door of a flood vent according to the invention.
Figure 1B:
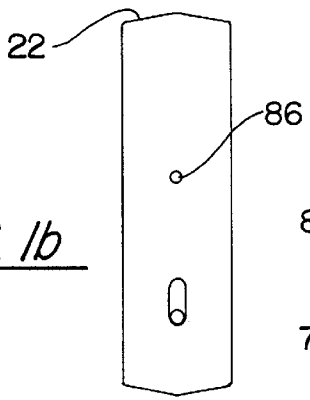
FIG. 1*b* is a side elevation of the door in FIG. 1*a*.
Figure 2A:
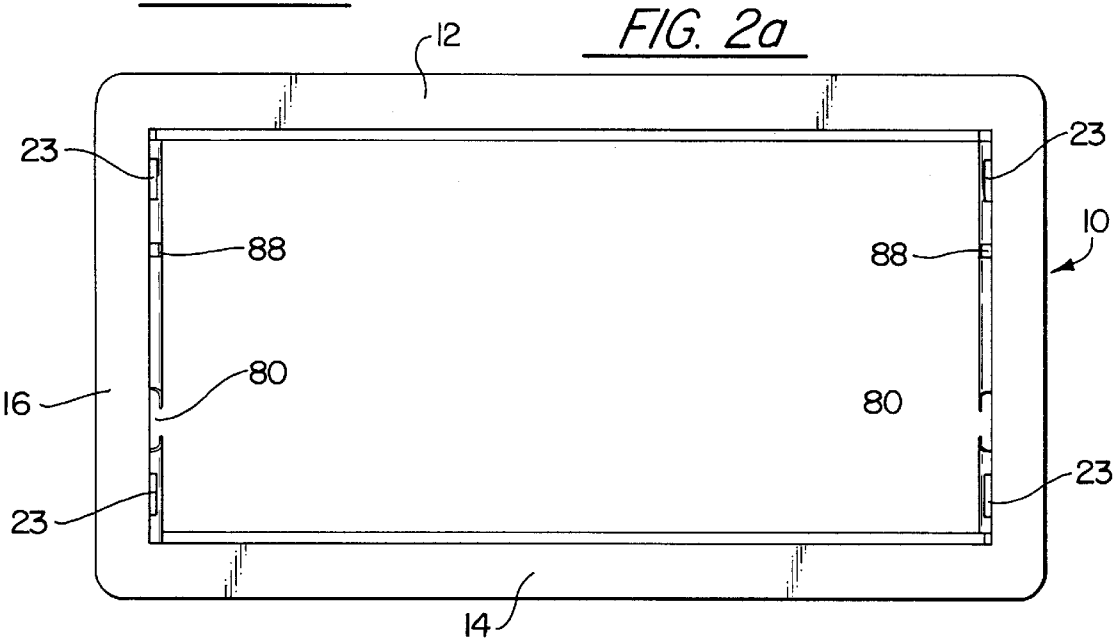
FIG. 2*a* is a front elevation of an outer frame of the flood vent.
Figure 2B:
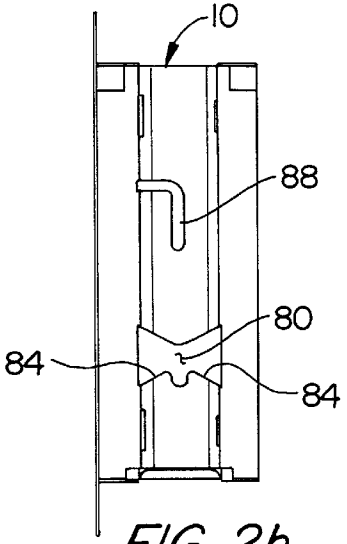
FIG. 2*b* is a side elevation of the outer frame in FIG. 2*a*.

FIGS. 1 and 2 illustrate the flood vent according to the preferred embodiment of an inventive arrangement. In the presently preferred embodiment, the flood vent has an outer frame 10 formed from a corrosion resistant material, preferably stainless steel. Although the outer frame is not limited as to a particular dimensioning, the dimensions of the outer frame 10 preferably vary from that of an 8"×16" concrete masonry unit (CMU) to 16"×16", that of two CMUs. In the presently preferred embodiment, the top rail 12 and the bottom rail 14 each are $17\frac{11}{16}$" long, and the side rails 16 are $9\frac{11}{16}$" long.

The door 22 is attached to the outer frame 10 so that the door 22 can pivot relative to the outer frame 10. Many features capable of pivoting the door 22 relative to the outer frame 10 is are well known in the art, and all such features are acceptable for use with this invention. However, the presently preferred features to attach the door 22 to the outer frame 10 are door pins 86 extending from sides of the door 22. The door pins 86 are adapted to be received within door slots 88 disposed within the outer frame 10.

The door 22 is preferably made with a corrosion-resistant material, most preferably stainless steel. The door 22 also comprises two mesh grilles 24 disposed on opposing faces of the door 22. Although the mesh grilles 24 will allow air and water to pass through the door 22; the size of the openings in the mesh grilles 24 are sufficiently small to prevent objects such as small animals or debris from passing through the door 22.

Any means of securing the outer frame 10 to a wall opening is acceptable. An example of a securing means is a set of stainless steel set screws. Divots can be drilled in the masonry prior to insertion of the setting screws to ensure proper security. Also, the perimeter can be caulked as required.

As illustrated in FIGS. 3–6, a presently preferred means of securing the outer frame 10 to the wall opening is with stakes 11. The stakes 11 include a forked longitudinal member 13 and an attachment portion 15. The attachment portion 15 preferably includes a slot through which a fastener, such as a nail or screw, can be inserted into the wall 17. The forked longitudinal member 13 preferably includes a pair of tines 19.

The tines 19 are configured to be inserted into a slot 23 in the outer frame 10 in one direction but resistant to removal in the opposite direction. Any feature on the tines 19 that resists removal in an opposite direction is acceptable; however, the preferred features are teeth 21 with each tooth 21 configured with two contact surfaces 25, 27. Also, the combined width of the tines 19 and teeth 21 are preferably greater than the width of the slots 23, and the perpendicular distance between the tines 19 is at least as great as the difference between the combined width of the tines 19 and teeth 21 and the width of the slots 23.

In the preferred embodiment, a first of the contact surfaces 25 is oriented at an angle relative to the direction the stake 11 is to be inserted into the slot 23, and a second of the contact surfaces 27 is oriented substantially perpendicular to the insertion direction of the stake 11. Pressure from inserting of the stake 11 into the slot 23 against this angled contact surface 25 forces the tines 19 towards one another and enables the stake 23 to be inserted into the slot 23. Also, because the second contact surface 27 is oriented substantially perpendicular to the insertion direction, this contact surface 27 prevents removal of the stake 11 from the slots 23. However, the stake 11 can be removed from the slots 23 if the tines 11 are forced together such that the combined width of the tines 19 and teeth 21 are less than the width of the slots 23.

This preferred embodiment of the attachment means has serveral advantages during installation, maintenance, and removal of the flood vent 8. During installation, the stakes 11 would preferably first be attached to the inside face of the wall 17. Attachment of the stakes 11 to the inside face is made easier because the flood vent 8 does not yet have to be inserted into the wall 17, which leaves an opening in the wall 17 that allows access to the inside face. Once the stakes 11 are secured, final installation only requires the flood vent 8 be slid into the opening with the stakes simultaneously being inserted into the slots 23.

Once inserted into the wall 17, the flood vent 8 is difficult to remove. However, if the flood vent 8 does have to be removed for maintenance, or any other purpose, holding the tines 19 together will enable the stakes 11 to be removed from the slots 23 and thereby allow the flood vent 8 to be removed from the wall 17. However, because this is a difficult and nonobvious process, it would discourage removal of the flood vent 8 by unauthorized persons.

Figure 9A:
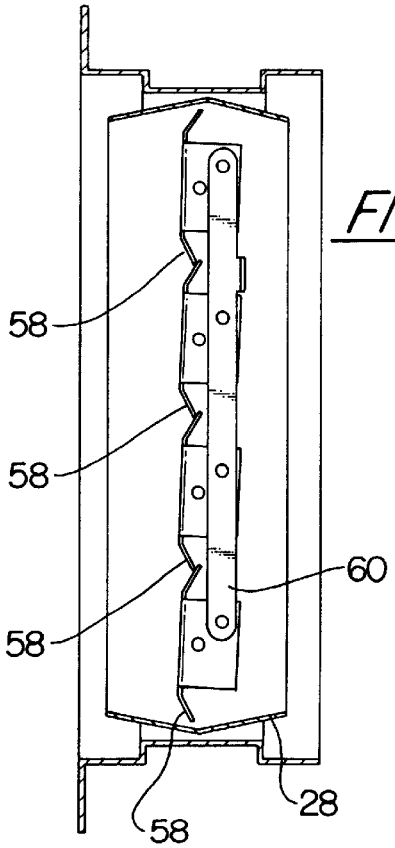
FIG. 9*a* is a cross section taken along line 9—9 in FIG. 7 showing the louvers in a closed position.
Figure 9B:
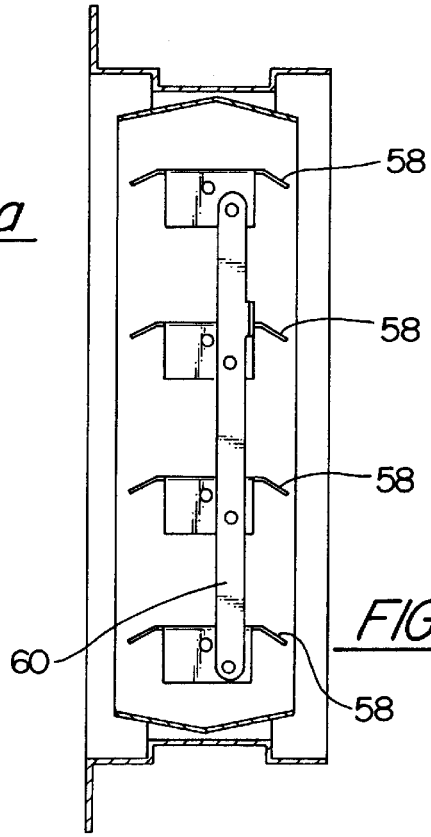
FIG. 9*b* is a cross section taken along line 9—9 in FIG. 7 showing the louvers in an open position.
Figure 3:
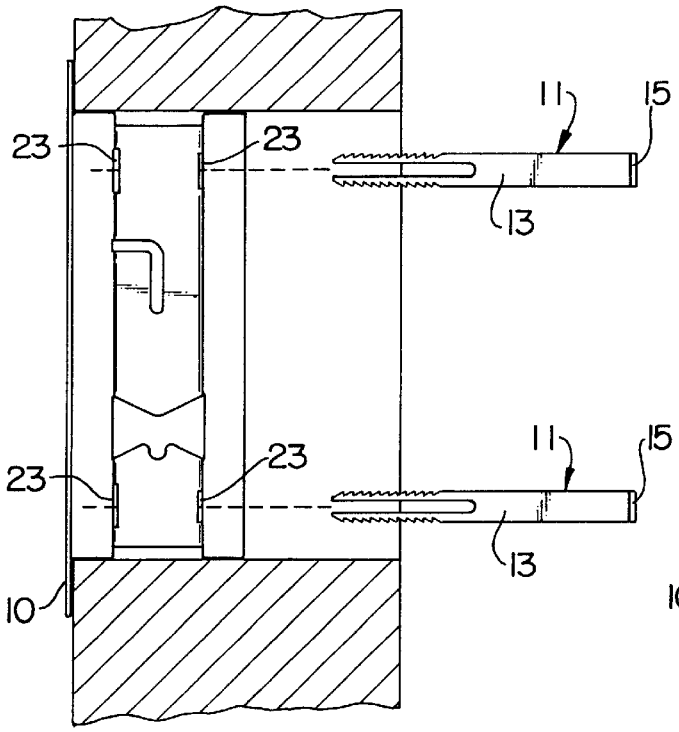
FIG. 3 is a side elevation of the flood vent inserted into a wall and stakes for attaching the flood vent to the wall.
Figure 4:
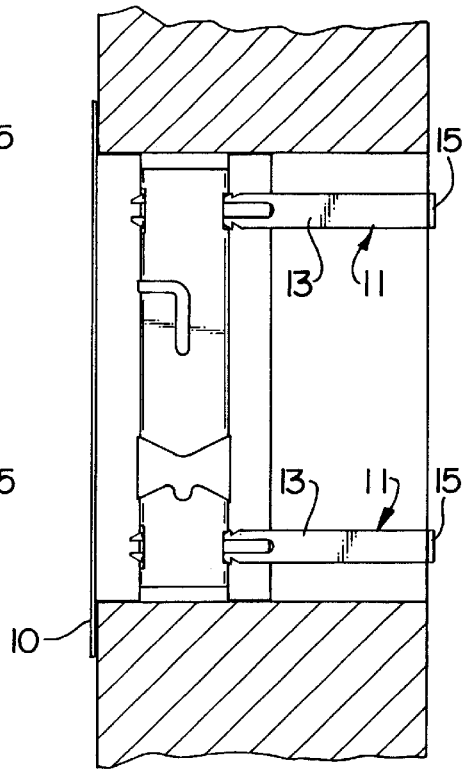
FIG. 4 shows the stakes of FIG. 3 inserted into the outer frame of the flood vent.
Figure 5:
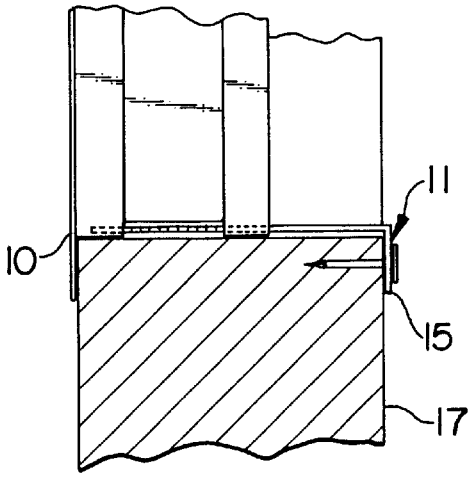
FIG. 5 is an expanded sectional side elevation of a stake attached to the wall.
Figure 6:
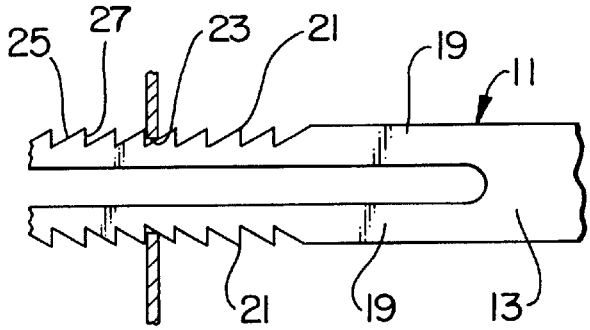
FIG. 6 is an expanded partial side elevation of the stake in FIG. 4 inserted into the outer frame of the flood vent.
Figure 7:
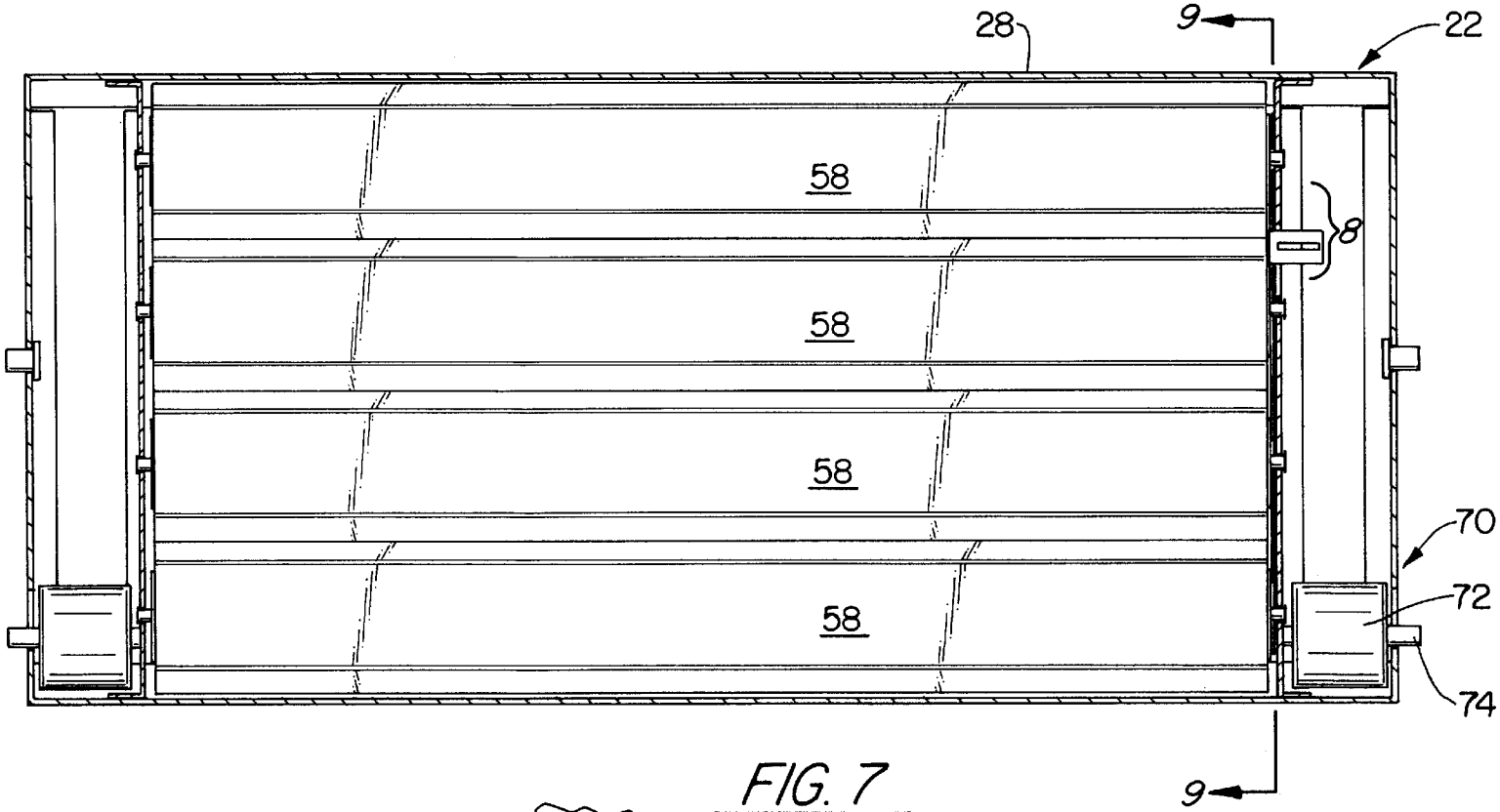
FIG. 7 is a sectional elevation of the door in FIG. 1*a*.
Figure 8:
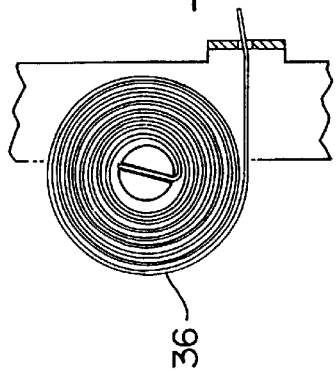
FIG. 8 is a detail side elevation of a temperature sensitive actuating device.
Figure 10:
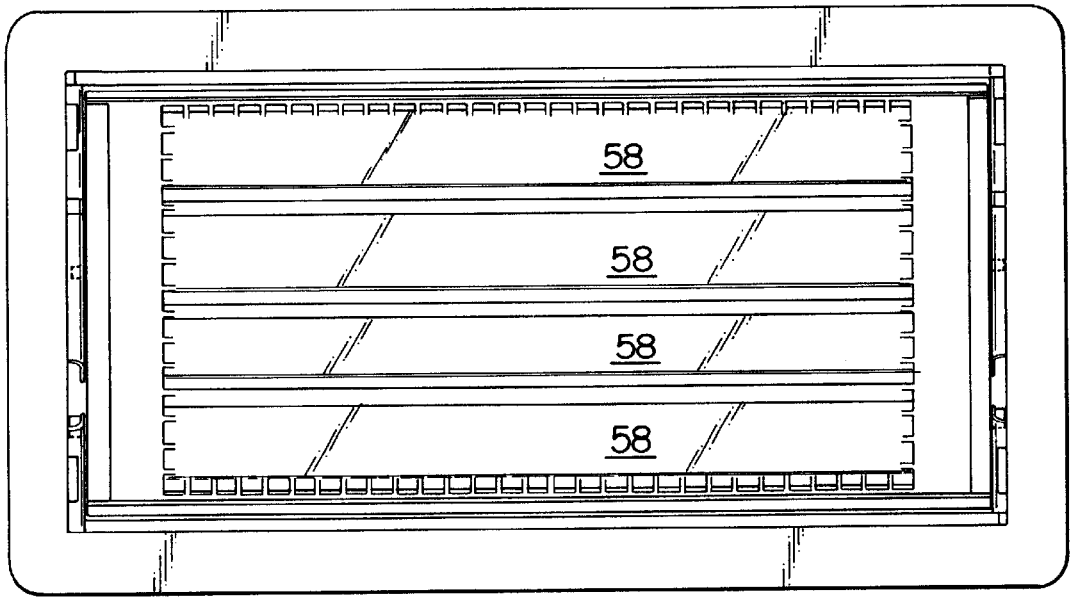
FIG. 10 is a front elevation of the flood vent showing the louvers in a closed position.

FIGS. 7 and 9–10 illustrate the equally spaced positioning of the finned louvers 58 within the door frame 28. A vertical rod 60, made from a corrosion-resistant, strong material, such as stainless steel, couples the finned louvers 58 to a temperature sensitive actuating device 36 (best illustrated in FIG. 8). The temperature sensitive actuating device 36, so named because the device translates thermal inputs into physical motion, is adjusted to drive the finned louvers 58 open during warm temperatures and to fully close the louvers when the temperature falls below forty degrees Fahrenheit.

FIG. 7 illustrates a sectional view of the latching mechanism 70. The latching mechanism 70 works by sensing the level of water passing through the flood vent 8, and at a preset level, the latching mechanism releases the door 22. At a time when the level of water has decreased sufficiently so that the door 22 hangs perpendicular to ground, the latching mechanism 70 is reset. Although any type of latching mechanism 70 so capable is acceptable, the presently preferred latching mechanism uses a float 72, which indicates the level of water. Although positioned within the door 22, the door 22 allows water to contact the float 72. Once the float 72 is lifted by the water to a preset level, the door 22 is released. Many types of devices are capable of sensing the float 72 at a pre-set level and capable of subsequently releasing the door 22, and the invention is not limited as to a particular type of sensing and releasing device.

Figure 11A:
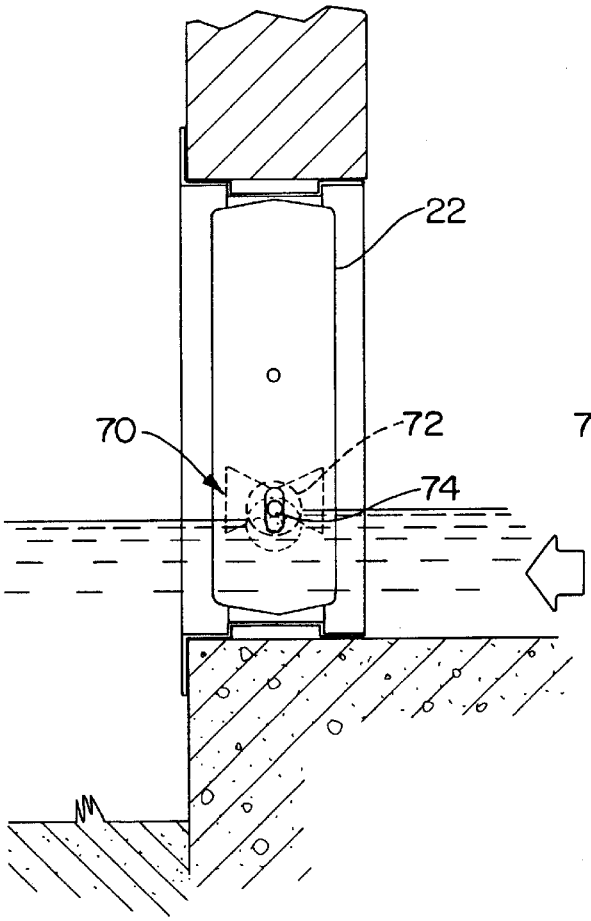
FIG. 11*a* is a cross-sectional side elevation of the flood vent showing the reaction of the float to an increasing or a decreasing water level.
Figure 11B:
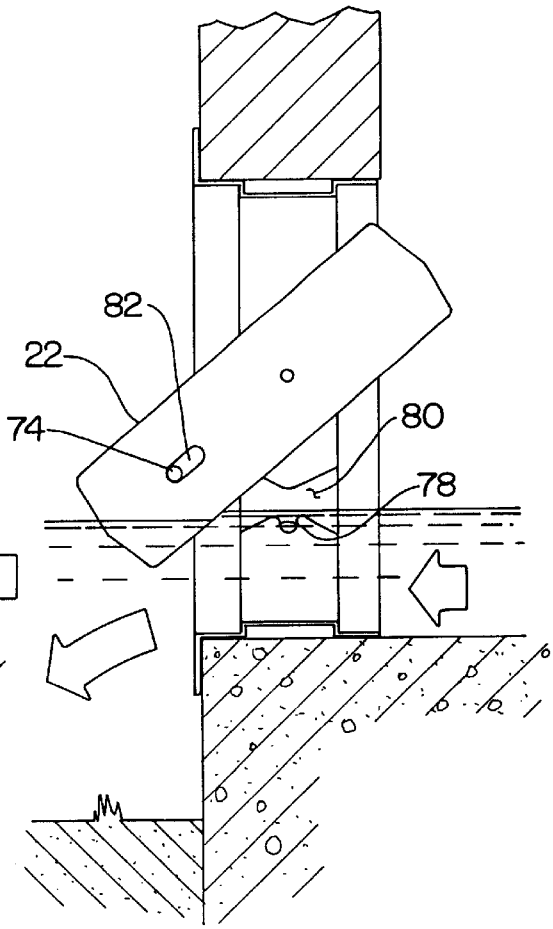
FIG. 11*b* is a cross-sectional side elevation of the flood vent showing the door swinging open after the float has released the door.

In a preferred embodiment, the sensing and releasing device is a pin 74 extending from the float 72 which is adapted to be inserted into an open slot 78 in the outer frame 10. As illustrated in FIG. 11*a,* when the pin 74 is positioned within the open slot 78, the door 22 is prevented from swinging in either direction. The position of the opening of the open slot 78 determines the level of water at which the door 22 will open. Once the float 72 is lifted by water such that the pin 74 exits the opening of the open slot 78, the pin 74 is not constrained by the open slot 78 and will tend to rotate in the direction of the current of the water as illustrated in FIG. 11*b*.

The outer frame 10 also preferably includes a channel 80 adapted for allowing passage of the pin 74 through the outer frame 10 as the door 22 rotates back or forth. The width of the channel 80 is preferably at least as great as the range of movement of the pin 74 in the door 22. The range of movement of the pin 74 is preferably constrained by a pin slot 82 in the door 22 through which the pin 74 extends.

Use of the float 72, pin 74 and open slot 78 also acts as a resetting mechanism. When the water level drops sufficiently, the pin 74 is lower than the opening in the open slot 78 if the door 22 is at a perpendicular position relative to ground. However, the door 22 may not be perpendicular until the weight of the door 22 overcomes the force of the current of water pushing against the door 22. Guides 84 (best shown in FIG. 2*b*) disposed on the outer frame 10 are used to position the pin 74 to the level of the opening in the open slot 78. These guides 84 are advantageously used when the door 22 returns to perpendicular at a level of water in which the pin 74 is much lower than the opening in the open slot 78. The guides 84 disposed on both sides of the open slot 78 are angled upward to position the pin 74 upward as the door 22 rotates to perpendicular. Upon reaching perpendicular, the pin 74 is at the level of the opening of the open slot 78, such the when the pin 74 is positioned over the opening, the pin 74 will fall into the open slot 78 thereby resetting the latching mechanism.

Figure 12:
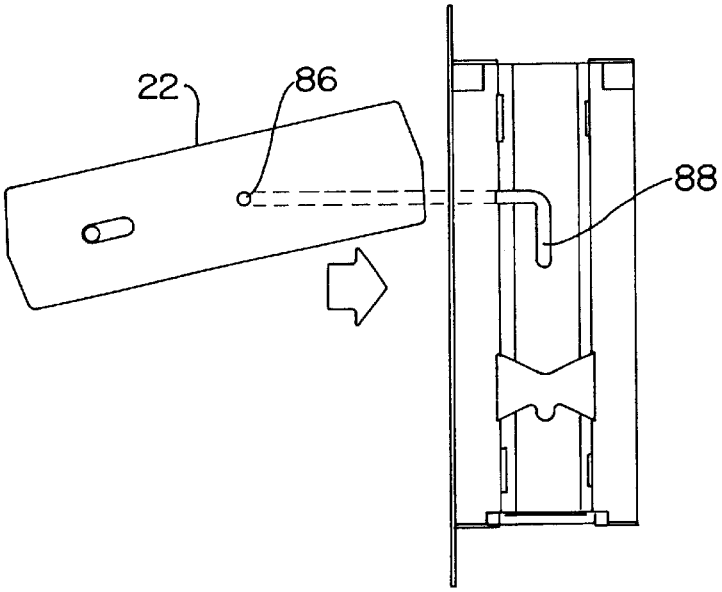
FIG. 12 is a side elevation of the door and outer frame before insertion of the door into the outer frame.
Figure 13A:
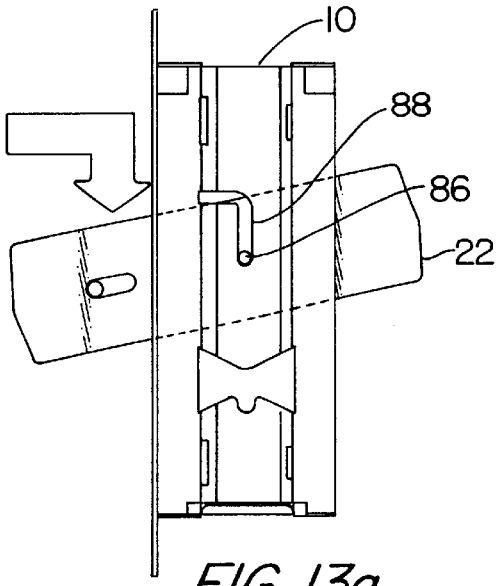
FIG. 13*a* is a side elevation of the door and outer frame showing the positional relationship of the door to the outer frame during the insertion of the door into the outer frame.
Figure 13B:
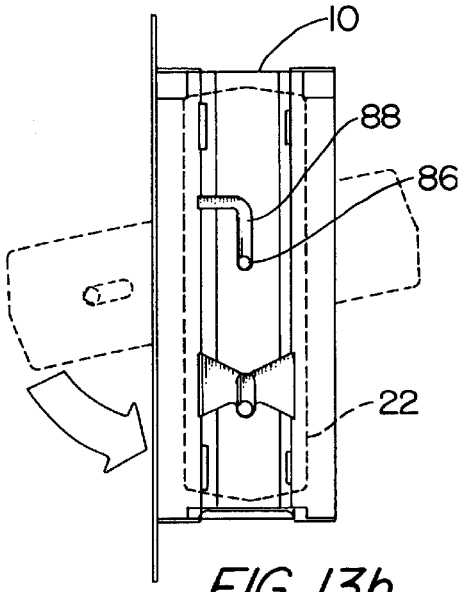
FIG. 13*b* is a side elevation of the door and outer frame illustrating the positioning of the door in FIG. 13*a* to a closed position.

FIGS. 12 and 13 illustrate the preferred features of the flood vent 8 for removing and inserting the door 22 into the outer frame 10. As shown in FIG. 12, the door 22 is first inserted into the frame 10 by positioning the door pins 86 on the door 22 into an opening of a door slot 88 in the outer frame 10. The opening of the door slot 88 is positioned slightly higher than the final vertical position of the door pins 86 so that the door 22 must be positioned at an angle relative to perpendicular to be inserted into the opening of the outer frame 10. Once each pin 86 is in its respective door slot 88 the door pin 86 is constrained from movement in any direction except along the length of the door slot 88. The bottom of the door slot 88 defines the final horizontal and vertical position of the door pins 86.

A length of the door slot 88 adjacent the bottom of the door slot ad is preferably perpendicular relative to ground. In so doing, the door pin 86 is constrained vertically even if the door pin 86 is positioned slightly upward. Also, this feature prevents the door 22 from being removed from the outer frame 10 when the door 22 is positioned perpendicular relative to ground. Thus, to remove the door 22, the door 22 must first be positioned at an angle other than perpendicular so that the door pins 86 can first be lifted upward in the door slot 88 and then towards the opening of the door slot 88.

It should be understood that the examples and embodiments described herein are for illustrative purposes only and that various modifications or changes in light thereof will be suggested to persons skilled in the art and are to be included within the spirit and purview of this application.

The invention can take other specific forms without departing from the spirit or essential attributes thereof for an indication of the scope of the invention.

What is claimed is:

1. A flood gate for use in a foundation wall adjacent an enclosed space, the flood gate comprising:

a frame located in the foundation wall defining a fluid passageway therethrough;

a door pivotally mounted in said frame for bidirectional rotation between two open positions and a closed position therebetween to permit flow of fluid therethrough; and at least one latching mechanism for holding said door in said closed position, said latching mechanism including a float for sensing a level of the fluid and releasing said door when the level exceeds a preset height.

2. The flood gate according to claim 1, wherein said float is disposed within said door, said door permitting the fluid to contact said float.

3. The flood gate according to claim 1, wherein said latching mechanism includes a sensing and releasing device to sense the height of the float and to release said door when said float is at the preset height.

4. The flood gate according to claim 4, wherein said frame defines an open slot adjacent said float, said sensing and releasing device is a pin extending from the float, said pin adapted to be inserted into said open slot, said pin being positioned within said open slot preventing said door from pivoting.

5. The flood gate according to claim 4, wherein said open slot includes an opening, the position of said opening determining the preset level, whereby upon the fluid lifting said float to said preset level, said pin exits said opening of said open slot and said pin is unconstrained by said open slot thereby enabling said door to rotate between said two open positions.

6. The flood gate according to claim 4, wherein said frame defines a channel enabling passage of said pin through said frame when said door rotates between said two open positions.

7. The flood gate according to claim 1, wherein said latching mechanism is resettable after releasing said door when said door is perpendicular to ground.

8. The flood gate according to claim 1, further comprising at least one stake for attaching said flood gate to the wall.

9. The flood gate according to claim 8, wherein each stake includes:

a longitudinal member, and an attachment portion.

10. The flood gate according to claim 9, wherein said frame defines a tine slot for receiving said longitudinal member, and said longitudinal member is insertable into said tine slot in a first direction and resistant to removal in an opposite direction from said first direction.

11. The flood gate according to claim 1, wherein said frame defines opposing door slots and said door includes opposing door pins respectively positionable within said opposing door slots, each of said door slots including a bottom defining a resting vertical and horizontal position of said door pins upon insertion into said door slots.

12. The flood gate according to claim 11, wherein each of said door slots includes:

a door slot opening positioned above said resting vertical position, and a lower portion adjacent said bottom of said door slot, said lower portion being perpendicular relative to ground.

13. The flood gate according to claim 11, wherein each of said door pins is respectively pivotable within said door slot.

14. The flood gate according to claim 1, wherein said door includes:

a ventilation opening, an automatic louver assembly for controlling air flow through said ventilation opening; and, a screen covering said ventilation opening.

15. The flood gate according to claim 14, wherein said automatic louver assembly opens and closes responsive to ambient temperature.

16. The flood gate according to claim 14, wherein said automatic louver assembly comprises:

a plurality of louvers;

a temperature sensitive actuating device; and, a member connecting said plurality of louvers to said temperature sensitive actuating device.

17. A flood gate for use in a wall adjacent an enclosed space, the flood gate comprising:

a frame located in a wall defining a fluid passageway therethrough;

a door pivotally mounted in said frame for bidirectional rotation between two open positions and a closed position therebetween to permit flow of fluid therethrough; and, at least one latching mechanism for holding said door in said closed position, said latching mechanism sensing a level of the fluid and releasing said door when the level exceeds a preset height;

wherein said latching mechanism includes a float to determine the level of the fluid, said float is disposed within said door and said door permitting the fluid to contact said float.

18. A flood gate for use in a wall adjacent an enclosed space, the flood gate comprising:

a frame located in a wall defining a fluid passageway therethrough;

a door pivotally mounted in said frame for bidirectional rotation between two open positions and a closed position therebetween to permit flow of fluid therethrough; and, at least one latching mechanism for holding said door in said closed position, said latching mechanism sensing a level of the fluid and releasing said door when the level exceeds a preset height;

wherein said frame defines opposing door slots and said door includes opposing door pins respectively positionable within said opposing door slots, each of said door slots including a bottom defining a resting vertical and horizontal position of said door pins upon insertion into said door slots.

19. The flood gate according to claim 18, wherein each of said door slots includes:

a door slot opening positioned above said resting vertical position, and a lower portion adjacent said bottom of said door slot, said lower portion being perpendicular relative to ground.

20. The flood gate according to claim 18, wherein each of said door pins is respectively pivotable within said door slot.

21. A flood gate for use in a wall adjacent an enclosed space, the flood gate comprising:

a frame located in a wall defining a fluid passageway therethrough;

a door pivotally mounted in said frame for bidirectional rotation between two open positions and a closed position therebetween to permit flow of fluid therethrough; and, at least one latching mechanism for holding said door in said closed position, said latching mechanism including a float to determine a level of the fluid, and a sensing and releasing device to sense the height of the float and to release said door when the level exceeds a preset height;

wherein said frame defines an open slot adjacent said float, said sensing and releasing device is a pin extending from the float, said pin adapted to be inserted into said open slot, said pin being positioned within said open slot preventing said door from pivoting.

22. The flood gate according to claim 21, wherein said open slot includes an opening, the position of said opening determining the preset level, whereby upon the fluid lifting said float to said preset level, said pin exits said opening of said open slot and said pin is unconstrained by said open slot thereby enabling said door to rotate between said two open positions.

23. The flood gate according to claim 22, wherein said frame defines a channel enabling passage of said pin through said frame when said door rotates between said two open positions.

24. A flood gate for use in a wall adjacent an enclosed space, the flood gate comprising:

a frame located in a wall defining a fluid passageway therethrough;

a door pivotally mounted in said frame for bidirectional rotation between two open positions and a closed position therebetween to permit flow of fluid therethrough;

at least one latching mechanism for holding said door in said closed position, said latching mechanism including a float to determine a level of the fluid, and a sensing and releasing device to sense the height of the float and to release said door when the level exceeds a preset height; and, at least one stake for attaching said flood gate to the wall, said stake including a longitudinal member, and an attachment portion;

wherein said frame defines a tine slot for receiving said longitudinal member, said longitudinal member being insertable into said tine slot in a first direction and resistant to removal in an opposite direction from said first direction.

* * * * *

UNITED STATES PATENT AND TRADEMARK OFFICE

CERTIFICATE OF CORRECTION

PATENT NO. : 6,287,050 B1
DATED : September 11, 2001
INVENTOR(S) : Martin J. Montgomery and E. Carl Sprengle It is certified that error appears in the above-identified patent and that said Letters Patent is hereby corrected as shown below:

Title page,
Item [75] replace "Glassboro" with -- Franklinville --

Column 1,
Line 32, replace "NOCA" with -- BOCA --
Line 62, replace "4,116,211" with -- 4,116,213 --

Column 2,
Line 25, replace "Vagedeg" with -- Vagedes --
Line 32, replace "ventilator" with -- VENTILATOR, --

Column 3,
Line 37, insert the word -- of -- in between "adjusting" and "vents"

Column 4,
Line 51, insert the word -- preferably -- after the word "also"

Column 5,
Line 9, insert the word -- presently -- before the word "preferred"

Column 6,
Line 65, replace "ad" with -- 88 --

Column 7,
Line 35, replace "according to claim 4" with -- according to claim 3 --

Signed and Sealed this

Fourteenth Day of May, 2002

*Attest:*

*Attesting Officer*

JAMES E. ROGAN
*Director of the United States Patent and Trademark Office*